US009664035B2

(12) United States Patent
Nyhavn

(10) Patent No.: US 9,664,035 B2
(45) Date of Patent: May 30, 2017

(54) MONITORING OF MULTILAYER RESERVOIRS

(71) Applicant: ResMan AS, Ranheim (NO)

(72) Inventor: Fridtjof Nyhavn, Trondheim (NO)

(73) Assignee: RESMAN AS, Ranheim (NO)

( * ) Notice: Subject to any disclaimer, the term of this patent is extended or adjusted under 35 U.S.C. 154(b) by 260 days.

(21) Appl. No.: 14/412,040

(22) PCT Filed: Jul. 1, 2013

(86) PCT No.: PCT/NO2013/050121
§ 371 (c)(1),
(2) Date: Dec. 30, 2014

(87) PCT Pub. No.: WO2014/007645
PCT Pub. Date: Jan. 9, 2014

(65) Prior Publication Data

US 2015/0176396 A1 Jun. 25, 2015

(30) Foreign Application Priority Data

Jul. 2, 2012 (NO) ..... 20120763

(51) Int. Cl.
*E21B 47/10* (2012.01)
*E21B 47/00* (2012.01)
*E21B 43/14* (2006.01)

(52) U.S. Cl.
CPC ..... *E21B 47/1015* (2013.01); *E21B 43/14* (2013.01); *E21B 47/00* (2013.01)

(58) Field of Classification Search
CPC ..... E21B 43/14; E21B 47/1015; E21B 47/00
See application file for complete search history.

(56) References Cited

U.S. PATENT DOCUMENTS 3,134,904 A * 5/1964 Hubbard, Jr. ..... G01V 5/14 250/260
5,047,632 A * 9/1991 Hunt ..... E21B 27/02 250/259

(Continued)

FOREIGN PATENT DOCUMENTS

WO 01/81914 11/2001
WO 2010/005319 1/2010

(Continued)

OTHER PUBLICATIONS

International Search Report issued Sep. 30, 2013 in corresponding International Application No. PCT/N02013/050121.

(Continued)

*Primary Examiner* — John Fitzgerald
(74) *Attorney, Agent, or Firm* — Wenderoth, Lind & Ponack, L.L.P.

(57) ABSTRACT

A method and system is described for estimating flow rates of fluids from each of separate influx zones in a multilayered reservoir to a production flow (Q) in a well (Wr) in the reservoir, the well having at least two separate influx zones from the multilayer reservoir of known positions along the well, the well being provided with distinct tracer sources with distinct tracer materials of known positions in each of the at least two separate influx zones. Each influx zone is provided with a delay path for a tracer leakout stream flow from that influx zone. The method includes providing a global production flow change for the production flow in the well, establishing tracer concentrations in the production flow of the distinct tracer materials as a function of time, and estimating the production rates from each of the separate influx zones in the reservoir.

29 Claims, 6 Drawing Sheets

(56) References Cited

U.S. PATENT DOCUMENTS

| | | | | |
|---|---|---|---|---|
| 5,892,147 | A * | 4/1999 | Garnes | E21B 43/117 73/152.14 |
| 6,003,365 | A * | 12/1999 | Pope | B09C 1/00 166/246 |
| 6,645,769 | B2 * | 11/2003 | Tayebi | E21B 47/1015 166/246 |
| 8,464,581 | B2 * | 6/2013 | Rytlewski | E21B 47/1015 73/152.29 |
| 8,596,354 | B2 * | 12/2013 | Hartshorne | E21B 47/1015 166/250.12 |
| 8,603,827 | B2 * | 12/2013 | Zahlsen | E21B 47/1015 166/250.01 |
| 8,949,029 | B2 * | 2/2015 | Nyhavn | E21B 27/02 166/252.6 |
| 9,194,226 | B2 * | 11/2015 | Blair | E21B 43/26 |
| 9,206,683 | B2 * | 12/2015 | Blair | E21B 43/26 |
| 9,212,540 | B2 * | 12/2015 | Woiceshyn | E21B 47/1015 |
| 9,267,371 | B2 * | 2/2016 | Blair | E21B 47/1015 |
| 9,422,793 | B2 * | 8/2016 | Gomes | E21B 43/08 |
| 2001/0036667 | A1 * | 11/2001 | Tayebi | E21B 47/1015 436/56 |
| 2003/0056952 | A1 | 3/2003 | Stegemeier et al. | |
| 2005/0252286 | A1 * | 11/2005 | Ibrahim | G01N 33/2823 73/152.55 |
| 2010/0147066 | A1 | 6/2010 | Ziauddin | |
| 2011/0257887 | A1 * | 10/2011 | Cooper | E21B 47/1015 702/12 |
| 2012/0118564 | A1 * | 5/2012 | Gomes | E21B 43/08 166/250.12 |
| 2013/0075090 | A1 * | 3/2013 | Woiceshyn | E21B 47/1015 166/250.12 |
| 2013/0268198 | A1 * | 10/2013 | Nyhavn | E21B 27/02 702/6 |

FOREIGN PATENT DOCUMENTS

| | | |
|---|---|---|
| WO | 2011/153635 | 12/2011 |
| WO | 2012/057634 | 5/2012 |

OTHER PUBLICATIONS

Norwegian Search Report issued Dec. 19, 2012 in corresponding Norwegian Application No. 20120763.

Yan Pan et al., "Best Practices in Testing and Analyzing Multilayer Reservoirs", SPE 132596, Society of Petroleum Engineers, SPE Western Regional Meeting, Anaheim, California, USA, May 27-29, 2010, pp. 1-11.

Extended European Search Report issued Jun. 21, 2016 in corresponding European Application No. 13812901.0.

* cited by examiner

MONITORING OF MULTILAYER RESERVOIRS

BACKGROUND OF THE INVENTION

1. Field of the Invention

The present invention concerns a method and system for estimating flow rates of fluids from each of separate influx zones in a multilayered reservoir to a production flow in a well in the reservoir.

The method and system may be used for indicating potential crossflow in wells that are draining multilayered reservoirs. The method and system may further be used for estimating influx volumes of fluids from zones in a multilayered reservoir with potential crossflow to a production flow in a well. The fluids may be water, oil, or gas.

2. Description of Related Art

In multilayered reservoirs, the hydrocarbon production flow may be produced from multiple zones having different properties and different backpressures. This results in a situation where the produced hydrocarbons from a zone may flow into the well and out into other zones in the formation, a phenomenon called crossflow. The effect is mostly experienced when wells are shut in and at low flow rates.

A method for monitoring and characterizing multilayered reservoirs is described in SPE 132596 "Best practices in Testing and Analyzing Multilayer Reservoirs" by Pan et al. and is based on testing and analyzing the pressure transient behavior of the multilayer reservoir in combination with the Selective Inflow Performance (SIP) production logging technique (PLT). In this paper, a production logging tool is measuring the flow profile and well hole pressures in the well during various flow rates. The logging tool is lowered down into the well and dragged up and down in the well, providing measurements in different zones in the well during the procedure. This procedure is very expensive and time consuming and the running of a PLT is not always an option due to poor accessibility. The procedure requires the logging tool inside the well, and thus the use of large equipment for handling the tool; e.g., a drilling vessel. There is also the risk of the logging tool getting stuck in the well with the possible result of complete abandonment of the well.

SUMMARY OF THE INVENTION

The present invention provides an optional solution to the problem above without well intervention. The inventive method and system is based on studying tracer flowback behavior with altering production rates from the well.

The invention provides a method for estimating flow rates of fluids from each of separate influx zones in a multilayered reservoir to a production flow in a well in the reservoir, the well having at least two separate influx zones from the multilayer reservoir of known positions along the well, the well being provided with distinct tracer sources with distinct tracer materials of known positions in each of the at least two separate influx zones. The method comprises providing a global production flow change for the production flow in the well, establishing tracer concentrations in the production flow of the distinct tracer materials as a function of time during the global flow change, and estimating the production rates from each of the separate influx zones in the reservoir. A delay path for a tracer leakout stream flow from each zone in the reservoir may be provided.

In an aspect, the invention provides a method for estimating flow rates of fluids from each of separate influx zones in a multilayered reservoir to a production flow in a well in the reservoir, the well having at least two separate influx zones from the multilayer reservoir of known positions along the well, the well being provided with distinct tracer sources with distinct tracer materials of known positions in each of the at least two separate influx zones wherein each influx zone is provided with a delay path for a tracer leakout stream flow from that influx zone, the method comprising:

a) providing a global production flow change for the production flow in the well, b) establishing tracer concentrations in the production flow of the distinct tracer materials as a function of time, and measuring time delays for tracer concentration changes of the distinct tracer materials from each zone resulting from the global production flow change; and c) estimating the production rates from each of the separate influx zones in the reservoir.

Each zone may further be provided with a specific entry point for a tracer leakout stream flow from each zone. The tracers may be arranged in the at least two separate influx zones in the multilayer reservoir during completion of the well. The tracers may in an embodiment be arranged in well equipment provided in the well.

In a further embodiment, the method may further comprise:

i) flowing the well at a high production rate,
  - collecting consecutive samples of said high production flow at the topside as a function of time or collecting cumulative production volumes of said high production flow at the topside, and
  - establishing concentrations of the distinct tracer materials from each of the at least two separate influx zones during the high production rate, and ii) flowing the well at a lower well production rate,
  - collecting consecutive samples of said lower production flow at the topside as a function of time or collecting cumulative production volumes of said lower production flow at the topside, and
  - establishing the concentrations of the distinct tracer materials during the lower well production rate.

The method may further comprise repeating steps i) and ii) for a number of decreasing production rates, monitoring tracer concentration transients in the production flow after each production rate decrease, and estimating the flow contributions from each of the at least two separate influx zones.

Decreasing production rates may comprise gradually decreasing the production flow rate. In an embodiment, the method may comprise establishing the flow rate for which the tracer concentration of at least one of the distinct tracer materials is disappearing from the production flow. In an embodiment, the method may comprise gradually decreasing the production flow rate until the at least one distinct tracer material is disappearing from the production flow.

In an embodiment, the method may further comprise gradually decreasing the production flow rate until a tracer concentration of at least one of the specific tracer materials in a sample of the production flow becomes zero.

Decreasing production rates may comprise stepwise decreasing the production flow rate.

The production flow change may comprise stepwise, gradually or continuously decreasing the production flow rate. The production flow change may comprise stepwise, gradually or continuously increasing the production flow rate.

The global production flow change may be provided by a ramp-up.

In an even further embodiment, the method comprises, based on said concentrations and their sampling times during gradually decreasing flow rates, establishing the tracer concentration transients after each rate change, and based on the tracer concentration transients after each rate change, estimating the flow contributions from each zone, noting the rate on which the tracer in a specific zone is disappearing and establishing rate-pressure curves for the different zones in the multilayer reservoir.

The global production flow change may be provided by a flush-out of the tracers. The tracers may be mechanically released from the tracer systems. The fluids may be at least one of water, oil or gas.

In a further aspect the invention provides a system for estimating flow rates of fluids from each of separate influx zones in a multilayered reservoir to a production flow in a well in the reservoir, where the well has at least two separate influx zones from the multilayer reservoir of known positions along the well. The system comprising: distinct tracer sources with distinct tracer materials arranged in known positions in each of the at least two separate influx zones of the well; apparatus for establishing tracer concentrations in the production flow of the distinct tracer materials as a function of time during a global flow change for the production flow in the well; and estimating the production rates from each of the separate influx zones in the reservoir. A delay path is provided for a tracer leakout stream flow from the distinct tracer sources in each influx zone in the reservoir.

The delay path in an influx zone may be provided by a distance between the distinct tracer sources and an entry point for the tracer leakout stream flow into a production baseline of the well.

The tracers may be arranged in the at least two separate influx zones in the multilayer reservoir during completion of the well. The tracers may be arranged in the reservoir formation, in a completion, a casing, a liner, or in equipment provided in the well. The tracers may be mechanically released or released upon interaction with a well fluid.

The method and system above may be used for indicating potential crossflow in wells that are draining multilayered reservoirs. The method and system may also be used for estimating influx volumes of fluids from zones in a multilayered reservoir with potential crossflow to a production flow in a well.

The fluids may be at least one of water, oil or gas.

BRIEF DESCRIPTION OF THE DRAWINGS

Example embodiments of the invention will now be described with reference to the followings drawings, where.

DETAILED DESCRIPTION

Figure 1:
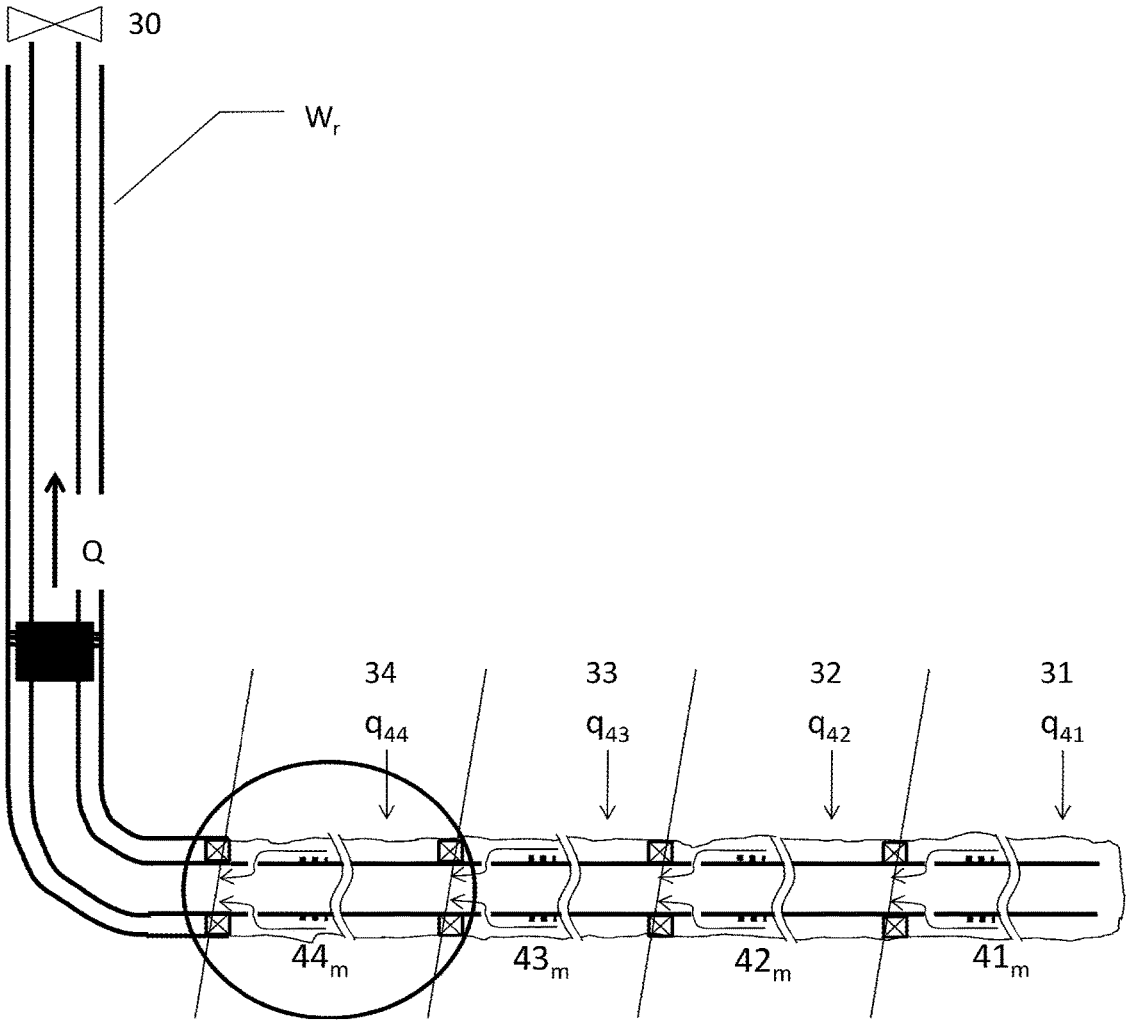
FIG. 1 illustrates a multilayer reservoir with a number of influx zones provided with tracer materials distinct for each influx zone according to an embodiment of the invention.

The present invention will be described with reference to the drawings. The same reference numerals are used for the same or similar features in all the drawings and throughout the description.

The present invention provides the use of tracers combined with production flow rate changes for the production flow in the production well, and monitoring tracer concentrations. The invention will be explained in detail below.

While the tracer systems are exposed to/wetted by their target fluid (e.g., water or hydrocarbons) there will be a leakage of tracer material from the zones in the reservoir/well. The leak-out rate of tracer material has been tuned to give a detectable signal at the sampling point for a given production rate over the lifetime for the tracer systems. The leakage rate is not dependent on the fluid velocity past the tracer systems, and no such velocity is required for the tracer material to leak into the surrounding fluids as long as the fluids are the target fluids for the given system. For an oil system, oil would be the target fluid and for a water system, water would be the target fluid.

This independence of fluid velocity means that while the well is shut-in and there are no flows past the tracer systems (assuming no cross-flow in the well), a high concentration of tracer material will build up in the vicinity of the tracer systems, a tracer shot. When the well is opened and the fluids flow towards the surface, the tracer shot will also migrate towards the sampling point of the well. If the tracer concentration in the fluids at the sampling point is measured as a function of time or volume, then the high concentration fluids passing the sampling point will give concentration peaks for each tracer in the well. The tracer concentration peaks and their arrival timing may carry information on zonal contribution.

However, with serious crossflows, fluids may never be still and shots may not be able to build up. Shut-in may also be a scenario that should be avoided from a production angle, as explained earlier.

The tracers that may be used in the present invention may be any kind of tracer influenced by the well fluids and for which the concentrations of tracer may be determined.

Non-limiting examples of tracers that may be used in the present invention are described in, e.g., WO0181914 and WO2010005319 (both belonging to the applicant of the present invention; Resman AS) which are hereby included by reference in their entirety. Once arranged in the well, these tracers may enable monitoring of the well or reservoir for decades.

The tracers used in the present invention may be arranged in the reservoir for the purpose of the invention. Alternatively, tracers already present in the different zones in the reservoir may be used. The tracers may be arranged in the reservoir during completion or in well equipment later installed in the well or reservoir. The tracers may be arranged in the influx zones in the multilayer reservoir during completion of the well. Further, the tracers may be arranged in the reservoir formation, in a completion, a casing, a liner, or in equipment provided in the well.

Mechanical release of tracers, and establishing tracer transients by using tracer shots may also be envisaged.

FIG. 1 illustrates a multilayer reservoir with a number of influx zones 3, (31, 32, 33, 34). Each influx zone is provided with tracer systems 4 (41*m*, 42*m*, 43*m*, 44*m*) with tracer materials distinct for each influx zone.

The multilayered reservoir in FIG. 1 is shown with four influx zones 3 (31, 32, 33, 34). The flow rates $q_i$ ($q_{41}$, $q_{42}$, $q_{43}$, $q_{44}$) of fluids from the influx zones of the multilayered reservoir flow into a well $W_r$, the flow rates constituting a production flow Q of the well. The number four is for illustration purposes only, and a multilayer reservoir may have a large number of different influx zones. The influx zones have known positions along the well $W_r$. The fluids from the influx zones leak out into a basepipe flow through entry points of known locations provided in each zone. The four influx zones represent four completion zones, where each completion zone is separated from another by flow isolation (e.g., packers). A choke 30 is provided for controlling the production flow from the well. As non-limiting examples, the entry points may be provided by apertures, openings in a completion, a pipe, or a screen, provided by valves, etc. The multilayer reservoir may be a hydrocarbon reservoir. The fluids may be at least one of water, oil or gas.

Tracer sources 41, 42, 43, 44 with distinct tracer materials $\mathbf{41}_m$, $\mathbf{42}_m$, $\mathbf{43}_m$, $\mathbf{44}_m$ distinct for each zone are arranged in each influx zone 31, 32, 33, 34. The tracer sources are arranged in known positions in each zone. Each of the distinct tracer materials $\mathbf{41}_m$, $\mathbf{42}_m$, $\mathbf{43}_m$, $\mathbf{44}_m$ have known tracer leak-out flux rates $f_{t41}$, $f_{t42}$, $f_{t43}$, $f_{t44}$ . . . to the surrounding influx fluids in the zone. The tracer leak-out flux rates are independent of fluid flow velocities. Each tracer leakout stream is flushed into the basepipe flow at a velocity proportional to the production rate in the zone and with corresponding flux contributions $f_{con41}$, $f_{con42}$, $f_{con43}$, $f_{con44}$.

The tracer leakout streams flow into the basepipe flow at known entry points in each zone together with the production flow from the zone.

A valve 30 in the embodiment in FIG. 1 is arranged at the topside for controlling the production flow. The valve is used in the procedure for global choking of the production flow. During the global choking procedure, the distinct tracer materials from each zone in the production flow are monitored as a function of time. The monitoring of the distinct tracer materials in the production flow provides a basis for estimating the fluid influx from each of the zones. An analyzing apparatus for identifying each distinct tracer material and measuring the concentration of each of the identified distinct tracer materials in the production flow is provided. The procedure will be further explained below. Samples ($c_1$, $c_2$, $c_3$, $c_4$ . . . ) of the production flow Q may be collected topside. The samples may be collected consecutively at sampling times ($t_1$, $t_2$, $t_3$, $t_4$ . . . ). Continuous online measurements may also be envisaged. Alternatively, cumulative production volumes ($f_1$, $f_2$, $f_3$, $f_4$) of the production flow Q may be collected topside. The samples are analyzed, identifying types of tracer materials ($\mathbf{4}_m$, $\mathbf{41}_m$, $\mathbf{42}_m$, $\mathbf{43}_m$) and the concentration of each of the identified tracer materials ($\mathbf{4}_c$, $\mathbf{41}_c$, $\mathbf{42}_c$, $\mathbf{43}_c$). Sampling equipment for sampling the tracer materials as a function of time in the production flow is arranged topside, but may also be arranged downhole in the well. Alternatively, cumulative production volumes may be collected. The samples or cumulative production volumes may be analyzed online, during sampling or retained for later analyses in appropriate analyzing equipment.

The invention will for ease of explanation be further explained in detail below with reference to one of the influx zones in the multilayer reservoir. This is not to be considered limiting for the invention and the principles of the description below hold for all the different influx zones in the multilayer reservoir.

Figure 1A:
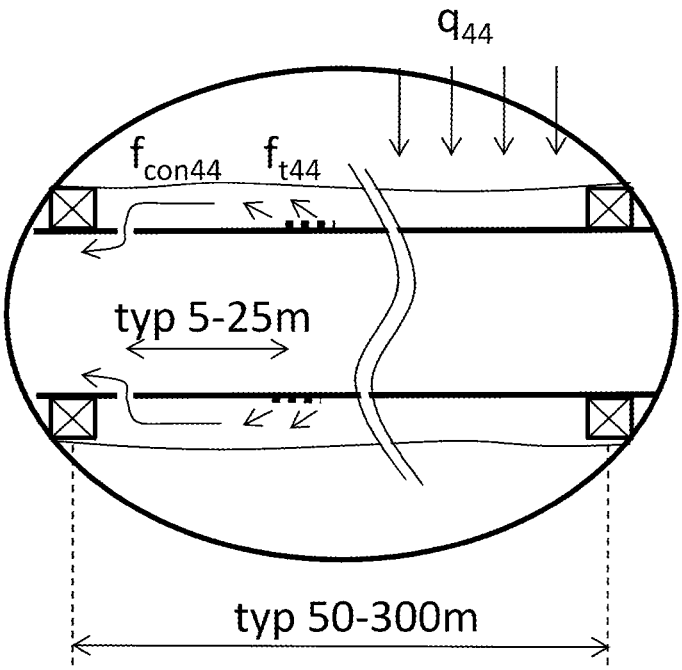
FIG. 1*a* shows an enlarged view of one of the influx zones from FIG. 1 illustrating a flux contribution from the zone and a distance between the tracer materials and an entry point for the flux contribution into the reservoir according to an embodiment of the invention.

FIG. 1*a* shows an enlarged view of the influx zone 34 from FIG. 1. The tracer system with distinct tracer materials $\mathbf{44}_m$ distinct for influx zone 34 is arranged in a known position in the influx zone 34. An entry point e44 for the leakout of the influx from zone 34 is also provided in a known position. A delay path is provided by the distance between the position of the distinct tracer material source 44*m* and the entry point e44 for the influx from zone 34 into the production baseline.

In FIG. 1*a*, it is indicated that the tracer system is arranged in a distance of typically 5-25 meters from the entry point, providing a delay path of 5-25 meters. A typical length of a tracer system is 1 meter. A typical length of an influx zone is 50-300 meters. The delay path may be adapted to the flow conditions and other well characteristics particular for a well.

There is a tracer leak-out flux rate $f_{t44}$ from the tracers arranged in influx zone 34.

Figure 1B:
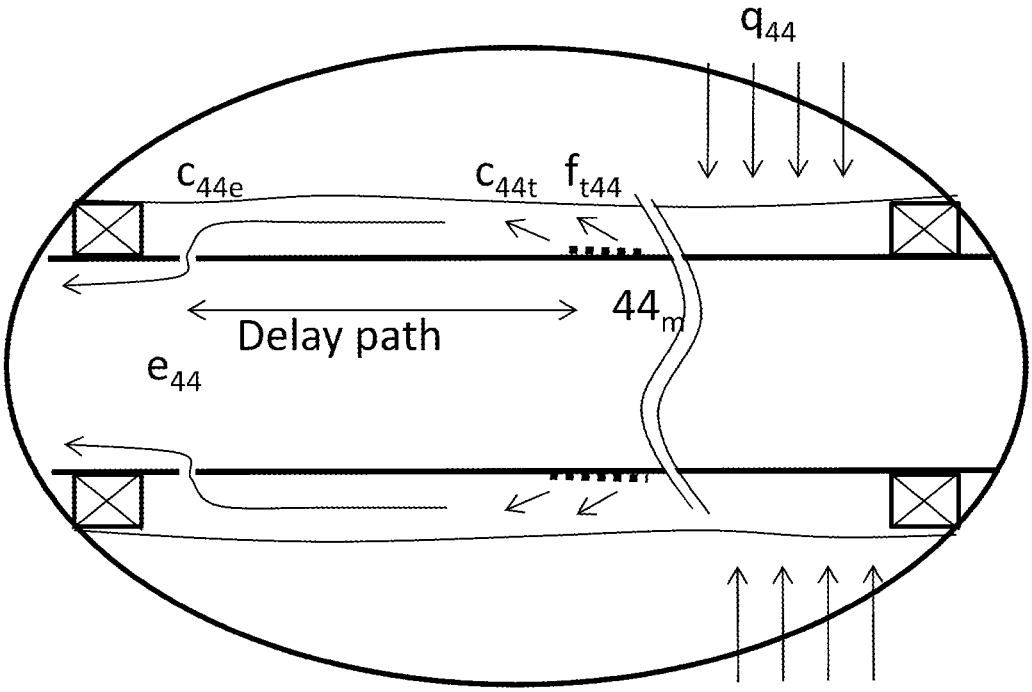
FIG. 1*b* shows an enlarged view of one of the influx zones from FIG. 1 with a zonal contribution and a delay path for the tracer materials into a production baseline, according to an embodiment of the invention.

FIG. 1*b* shows an enlarged view of the influx zone 34 from FIG. 1. A delay path for the distinct tracer materials in zone 34 is indicated.

The zonal contribution to the production flow Q in the well from the production zone 44 is the flow rate $q_{44}$ from the formation in this production zone, as illustrated in FIG. 1*b*. $f_{t44}$ is the tracer flux (mass/time unit) from the tracer system $\mathbf{44}_m$ arranged in this production zone. As long as the tracer system is constantly wetted with a flow from the formation in production zone 44, the tracer system will always release the same tracer flux $f_{t44}$. This tracer flux will set up a tracer concentration $C_{44t}$ right after the tracer release system in the influx zone. The tracer concentration $C_{44t}$ is inversely proportional to the flow rate $q_{44}$. With steady-state (constant over some time) flow rate $q_{44}$, the tracer concentration $C_{44t}$ will be the same as the tracer concentration at an entry point $C_{44e}$ to the basepipe flow in the well.

Figure 1C:
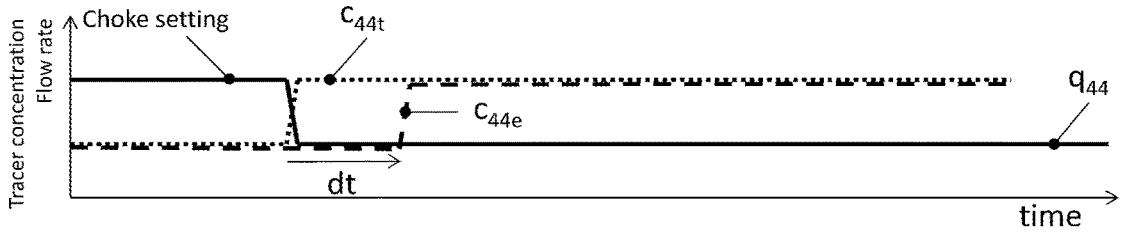
FIG. 1*c* illustrates a tracer concentration flow rate (dotted lines $C_{44t}C_{44e}$) as a function of time in the zone in FIG. 1*b* resulting from a flow rate change (choke setting), where C44t is the tracer concentration at a tracer system in the zone and C44e the tracer concentration in an entry point for the influx from the zone into the reservoir baseline and thus the topside tracer concentration, according to an embodiment of the invention.

If the flow rate $q_{44}$ is changed due to some change in topside or entry point choke setting, this change will immediately impact the tracer concentration $C_{44t}$ (inversely proportional to $q_{44}$) in the influx (production) zone 34 shown in FIG. 1*c*. The tracer concentration $C_{44t}$ is inversely proportional to the flow rate $q_{44}$. The tracer system in the zone will immediately be affected, but there is a time delay dt before the tracer concentration change C44e is seen in the production flow topside. This delay is mainly due to the delay path as will be explained below. This is reflected in FIG. 1*c* showing the tracer concentrations C44t, C44e as a function of time at the tracer system (C44t) in the influx zone and at the entry point (C44e), together with the choke setting curve plotted as flow rate $q_{44}$ as a function of time. The tracer concentration change will travel like a "wave" and with a speed that is proportional to the tracer flux/zonal flow $q_{44}$. After some time dt, the concentration change "wave" will reach the entry point $e_{44}$ to the basepipe flow and the tracer concentration $C_{44e}$ will change to the same new level as $C_{44t}$. This is shown in FIG. 1*c* illustrating the tracer concentration $C_{44}$ as a function of time t. The tracer leakout streams flow into the basepipe flow at specific entry points in each zone together with the production flow from the zone. The term "immediate" influence on the tracer system in this context may be in the order of minutes, e.g., due to the length of the tracer system in the zone and the flow rate in the zone. The time it takes for the tracer "wave" to reach the entry point, the delay time dt, depends on the influx flow rate, the length of the tracer system and the delay path for that particular influx zone, and well characteristics. The delay time may typically be in the range from about 5-15 minutes and up to several hours. Delay times below 5 minutes, and down to one minute may also be possible.

Figure 1D:
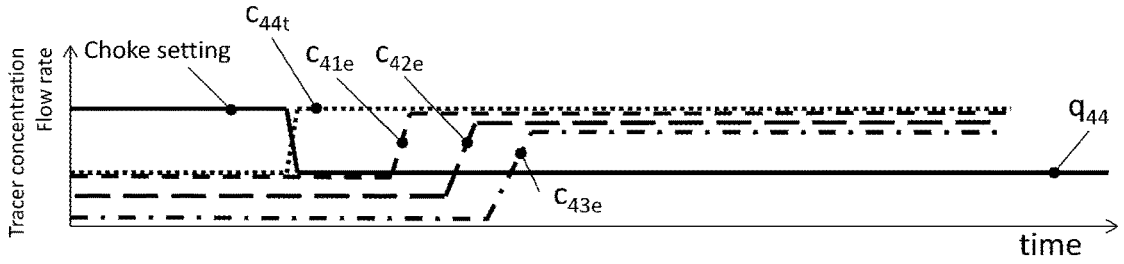
FIG. 1*d* illustrates tracer concentration flow rates (dotted lines $C_{44t}$ $C_{41e}$ $C_{42e}$ $C_{43e}$) as a function of time from the different zones in the multilayer reservoir illustrated in FIG. 1 resulting from a flow rate change due to a choke setting, where C44t is the tracer concentration at a tracer system in the zone according to an embodiment of the invention.

If multiple zones are flowed simultaneously in the same well in a multilayered reservoir and during a global choke change, the different tracer concentrations $c_{41e}$, $c_{42e}$, $c_{43e}$, from each zone will all appear at different times and according to the rates in the different zones. This situation is shown in FIG. 1*d*, which illustrates the tracer concentrations as a function of time from the different zones in the multilayer reservoir together with the flow rate decrease. When the topside valve is choked to reduce the production flow rate in the reservoir (choke setting curve), the tracer concentrations C41e, C42e, C43e from the different zones in the reservoir increase. The delay time dt between the flow rate decrease and the tracer concentration increase (the concentration change wave as explained above) for a zone, will depend upon the flow rate in that zone. C44t shows the immediate tracer concentration increase in the tracer system in a zone as explained above in relation to FIG. 1*c*. The specific tracer materials are arranged in the different production zones at known positions, and the entry points e44, e41, e42, e43 for the leakout flows of the tracer materials are known for each zone. The distance between the known positions for the specific tracers and the entry points for the tracers in each zone provide known delay paths for the tracer materials in each of the zones. By registering the time delays for the tracer concentration changes from each zone resulting from the global topside choke change as explained above, the production flow rate from each zone can thus be estimated. The production flow rate from a zone may be estimated from model based interpretation methodology where the basic principle is based on the measurement of the time delays. The method may provide absolute flow rates if zone responses are calibrated. Otherwise, the measurement of these delays may give relative numbers.

In an embodiment of the invention, a number of repeating measurements may typically be made. The measurements may be performed for a number of decreasing rates down to zero flow rate Q, if possible. The lower flow rate from the present measurement may provide a starting point for the following measurement. The measurements may also be performed for various flow rates serving as starting point for the measurement.

The method of obtaining the rates at varying flow rates as described above may be combined with the principles of the Selective Inflow Performance (SIP) method known from Wireline Production Logging, See also SPE 132596 "Best practices in testing and analyzing Multilayer Reservoirs".

The further embodiment of the invention provides choking back the production flow from full rate and monitoring changes in tracer concentration in the fluid flow from each influx zone until the time the concentration of distinct tracer materials from an influx zone (layer 2 in FIG. 3*a*) becomes zero (disappears). When the concentration of the tracer from the influx zone (layer 2 in FIG. 3*a*) becomes zero, the well pressure is approaching zero pressure from the zone (p2 in FIG. 3*a*). When the tracer concentration from influx zone 2 becomes zero (disappears), this implies that a crossflow from influx zone 2 into one of the other zones 1 or 3 has been established in the reservoir. This will be explained in detail below.

The production rate contributions from each zone in the reservoir are determined based on the method explained above in relation to FIGS. 1*a*-1*d* by measuring the delay times for the tracer concentration transients from the different zones in the reservoir which follow a production flow change. The further embodiment of the invention thus registers the flow rates for which the different tracers in the different influx zones/layers disappear due to the onset of crossflow as the flow rate is lowered. The production flow is choked back until one of the tracer concentrations becomes zero, and the tracer responses monitored for each flow rate step change. It is thus possible to estimate the zonal contributions estimated from the tracer flowback transients in the wells in a layered reservoir with shut-in crossflows.

Figure 2:
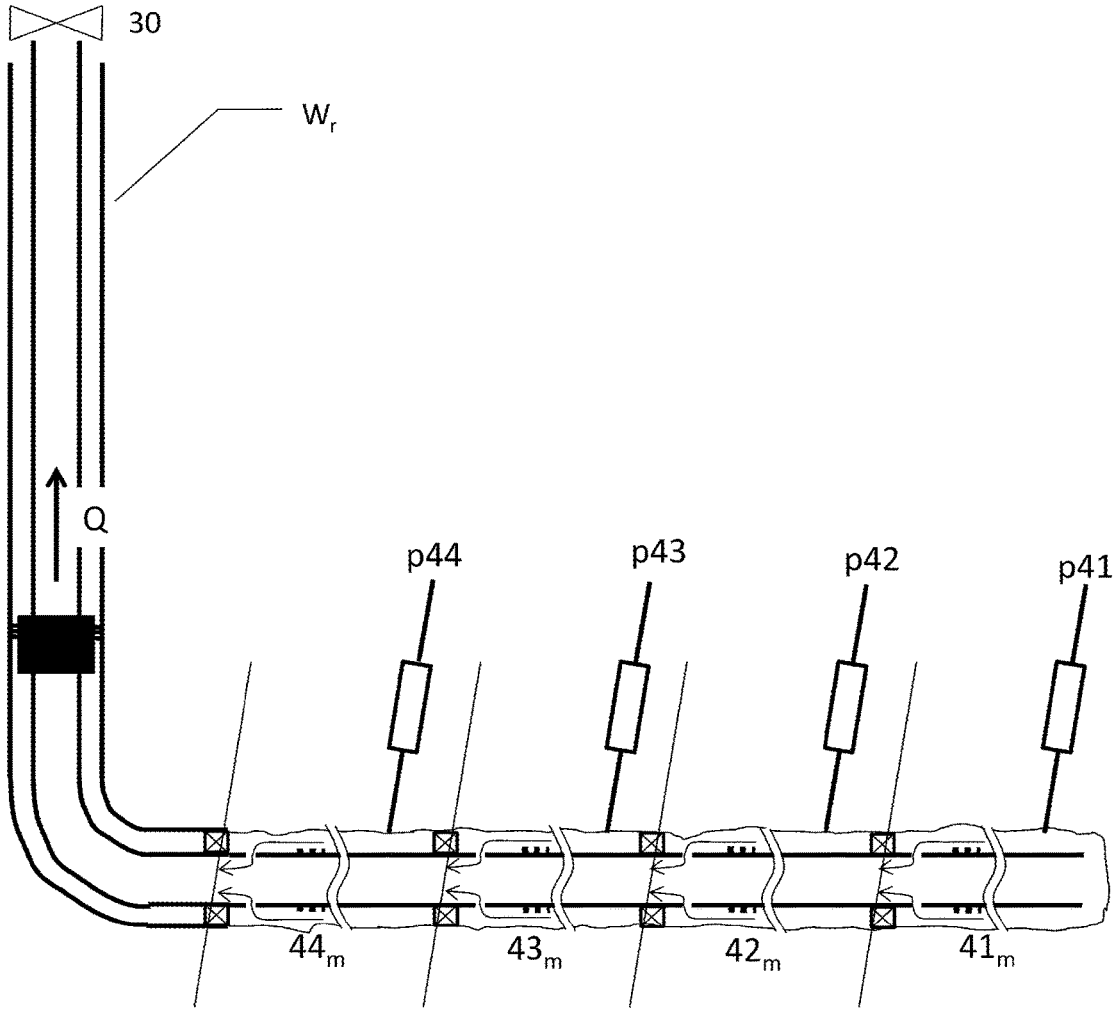
FIG. 2 illustrates a multilayered reservoir having four zones with possible different reservoir pressures and formation flow resistivities, where distinct tracer materials are arranged in each zone.

The change in production rate may be accomplished by controlling the valve 30 in the well. The following explanation of the method is for simplicity explained in view of a multilayer reservoir with four zones 44, 43, 42, 41, as illustrated in FIG. 2. The multilayered reservoir in FIG. 2 has four zones with different backpressures p (p44, p43, p42, p41) and formation flow resistivities I (I1, I2, I3, I4).

Figure 3A:
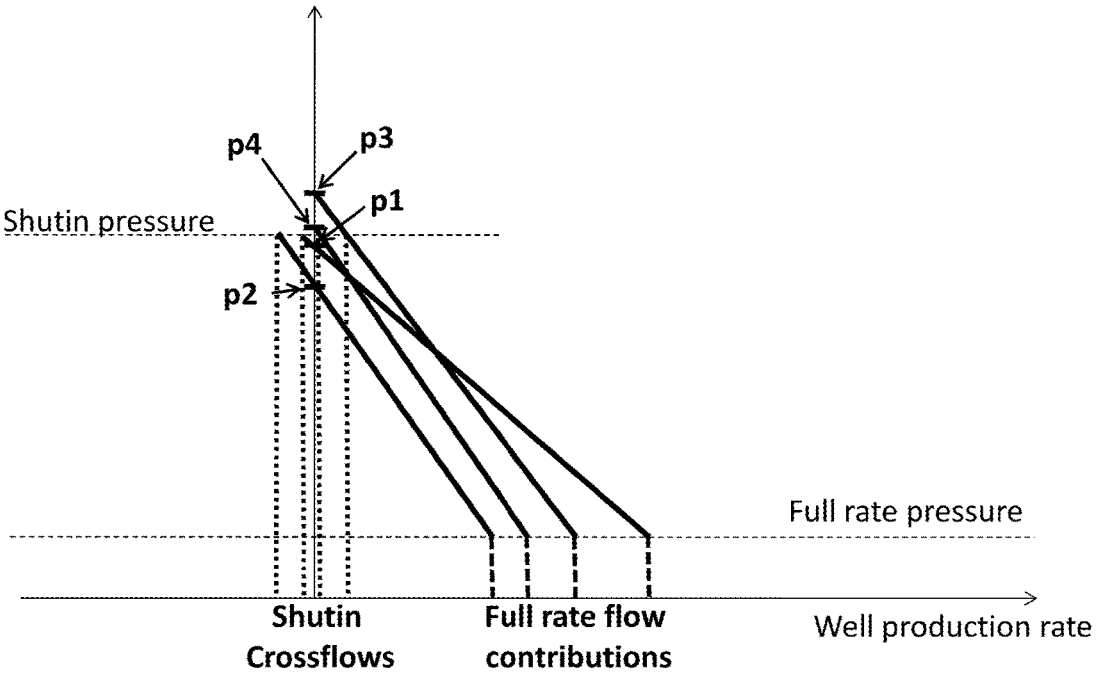
FIG. 3*a* shows rate pressure curves p1, p2, p3 and p4 for a multilayered reservoir with four zones together with indications of the full rate contributions and shut-in crossflows for the different zones.

FIG. 3*a* shows the pressures p1, p2, p3, p4 from the different zones in the multilayer reservoir from FIG. 2 plotted as a function of the well production rate. The straight lines of the production pressures p1, p2, p3, p4 from each influx zone are plotted, where the starting point of each straight line is the full rate pressure from each of the zones. The topside valve is then in a full open position. The slope of each straight line provides a layer production index from that influx zone. The slope of each of these lines provides the basis for estimating the influx from each of the zones. As shown in FIG. 3*a*, when producing at full rate, a flow distribution with the best production rate from influx zone 1 (layer1) and the poorest from influx zone 2 (layer2) may be had. This is shown by the intersection of the graphs (marked as p1, p2, p3, p4) for the different influx zones with the dotted line marked as full rate pressure in FIG. 3*a*. A shut-in pressure for each influx zone is shown with the dotted lines (shut-in crossflows) in FIG. 3*a*. Shut-in means that valve 30 is closed. In a shut-in well, a shut-in pressure (neglecting pressure drawdown along the well) that is something between the reservoir pressures given by the zonal production indexes would normally be seen. The plot in FIG. 3*a* shows that during shut-in there will be a crossflow from influx zone 3 into both influx zone 1 and 2. The well contributions from zones 1 and 2 are negative (negative production rates for p1 and p2). The invention is able to estimate the zonal contributions from each layer by recording tracer concentrations at a few production rates. The production flow from an oil well has a dynamic behavior. The changes in the fluid production rate and the fluid sampling are thus adapted to each well.

FIG. 3*a* is only for illustration purposes and not limiting for the invention. Other multilayer wells with a multitude of zones may have a different zone for which the tracer concentration is disappearing first. The changes in tracer concentration in the fluid flow may also in this embodiment be monitored online or monitored by taking samples from the fluid flow for later analyses.

The invention may also be performed for increasing pressure changes. The pressure changes may be performed in steps, gradually or continuously. The requirement is a pressure change.

In order to establish the pressure curves p1, p2, p3, p4 from each zone as a function of well production rate, a number of repeating measurements (samples) will typically be made. Tracer concentration transients after each rate change are established based on the concentrations and their sampling times during gradually decreasing flow rates, and used in estimating the flow contributions from each zone. The flow rate on which the tracer in a specific zone is disappearing (when the tracer concentration from the zone in a flow becomes zero) is used in establishing the shut-in pressure for that zone.

Figure 3B:
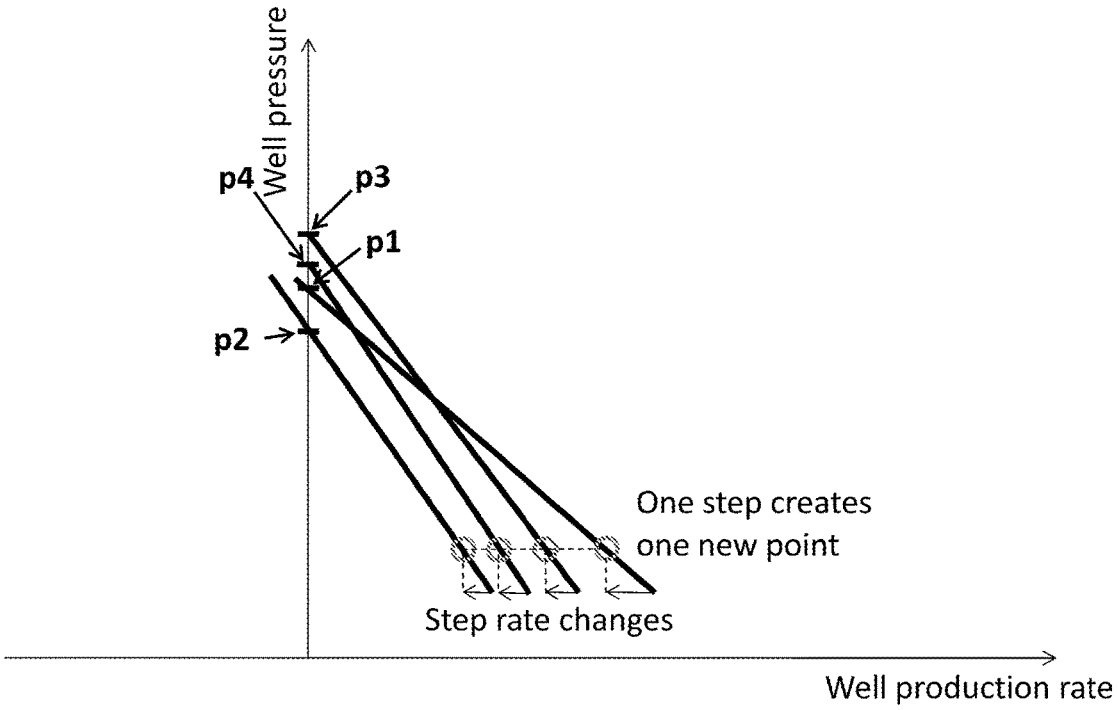
FIG. 3*b* illustrates creation of rate pressure curves p1, p2, p3 and p4 by step rate changes of the well production rate according to an embodiment of the invention.

FIG. 3*b* shows how a measurement during a step rate change creates a point for each zone in the diagram. When a number of points have been established for decreasing step rate changes, the straight lines of the production pressures p1, p2, p3, p4 (rate-pressure curves) from each influx zone are established by drawing up a straight line between the points.

Figure 4:
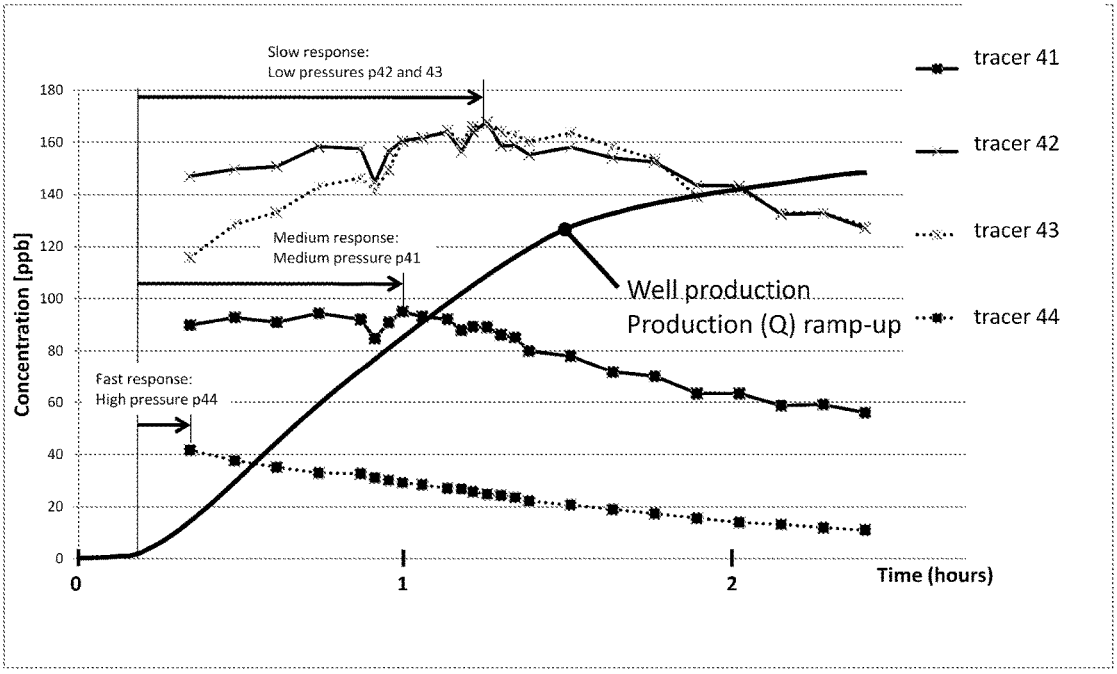
FIG. 4 shows an example of tracer concentrations as a function of time for the multilayer reservoir in FIG. 2 during a well production ramp-up according to an example embodiment of the invention.

FIG. 4 is a real field data example of the reservoir illustrated in FIG. 2. The tracer concentrations [in ppb] for the tracers from each zone, tracer 41, tracer 42, tracer 43 and tracer 44 are plotted as a function of time (hours) during a well production (Q) ramp-up. Ramp-up is initiated by full opening of the topside valve controlling the production flow. Full opening of the topside valve results in initiation of production from the different zones in the multilayer reservoir. During ramp-up, the production flow rate from the multilayer reservoir will typically gradually increase as shown in FIG. 4, thus providing the production flow change required for estimating the flow rates from each section based on the tracer concentrations. The tracer systems in the zones will immediately be affected when the production is started, but there is a time delay before the tracer concentrations are seen in the production flow topside. The tracer concentrations are inversely proportional to the flow rate from each zone. In FIG. 4, the tracer 44 from zone 44 has a fast response indicating a high pressure from zone 44. The tracer 41 from zone 41 has a medium response indicating a medium pressure from zone 41. The tracers 42 and 43 from zones 42 and 43, respectively, have a slow response indicating a low pressure from these zones.

Sampling programs performing the number of repeating measurements are tailor-made for each well. Typical sampling programs are as follows:

Option 1:

Fluids are sampled during production ramp-up as shown in FIG. 4 and described above. A large number of samples are taken, out of which typically 20-40 samples are analyzed to describe the different zonal tracer flowback concentrations during the production ramp-up. This will give qualitative indications of zonal contributions and possible crossflow between zones in the reservoir. The sampling period may often be extended to also get a better definition of the tail end of the curves.

Figure 5:
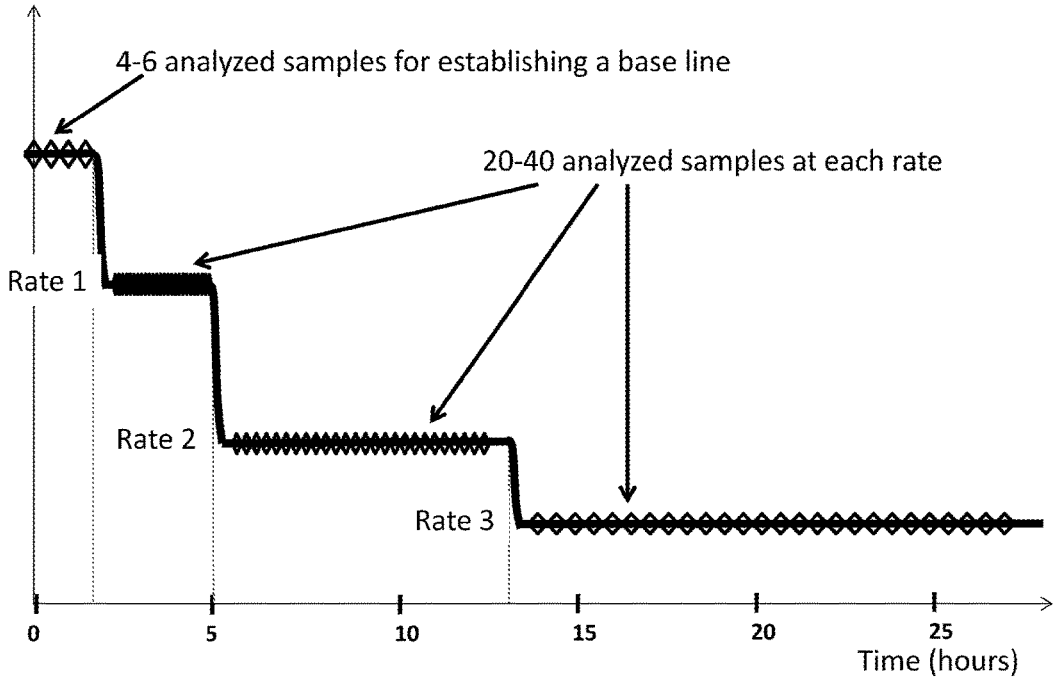
FIG. 5 illustrates an example embodiment of stepping down of production rate followed by sampling. After each down-step, there is a sequence of samples to catch tracer responses as indicated in FIGS. 1*c* and 1*d*.

Option 2:

Production rates are changed in steps and fluids are sampled. After each down-step, there is a sequence of samples to catch tracer responses as indicated in FIGS. 1*c* and 1 *d* and described above. An example of such a procedure of stepping down of the production rate is shown in FIG. 5. Note that stepping up the rates would in theory be equal. Before down-stepping the production rate, a number of samples are analyzed for establishing a baseline. The procedure starts at time=0 with the measurements for establishing the baseline. Normally, 4-6 samples are sufficient for this purpose and the samples are typically sampled during a time interval of 1-2 hours. The production rate is thereafter reduced in a first down-step starting at about t=2 hours. In the example in FIG. 5, the first down-step is performed from full production rate to a rate 1. Repeating measurements are performed and 20-40 samples are analyzed. The repeating measurements are performed in a time window of about 3 hours. At about t=5 hours, the production rate is further stepped down to a rate 2. Repeating measurements are performed and 20-40 samples are analyzed. The repeating measurements are performed in a time window of about 8 hours. At about t=13 hours, the production rate is further stepped down to a rate 3. Repeating measurements are performed and 20-40 samples are analyzed. The repeating measurements are performed in a time window of about 14 hours.

The down-steps are performed relatively quickly in view of the entire sampling procedure. Typically, each down-step is performed in about 15-30 minutes in order to have a controlled and smooth reduction of production flow. The time for each down-step is, however, tailor-made for each well. An (in theory) equal number of samples are taken after each rate step-down. In practice there may be deviations from this, but a small deviation will not have any significance for the functionality. Normally, 60-100 samples are taken after each production rate, out of which 20-40 samples are analyzed. To establish a baseline, a more limited number of samples and analyzed samples are normally required. In the example in FIG. 5, 4-6 samples are analyzed for establishing the baseline. The sampling frequency will be higher for high rates and lower for low rates. This is also seen in the example in FIG. 5, where the sampling frequency is indicated with a wave pattern overlying the bold line. Note that a sequence of different production steps will normally take more time than a ramp-up.

The method and system may be used for indicating potential crossflow in wells that are draining multilayered reservoirs. The method and system may further be used for estimating influx volumes of fluids from zones in a multilayered reservoir with potential crossflow to a production flow in a well. The fluids may be at least one of water, oil or gas.

Having described preferred embodiments of the invention, it will be apparent to those skilled in the art that other embodiments incorporating the concepts may be used. These and other examples of the invention illustrated above are intended by way of example only and the actual scope of the invention is to be determined from the following claims.

The invention claimed is:

1. A method for estimating production flow rates of fluids from each of separate influx zones in a multilayer reservoir to a production flow in a well in the multilayer reservoir, the well having at least two separate influx zones from the multilayer reservoir of known positions along the well, the well being provided with distinct tracer sources with distinct tracer materials of known positions in each of the at least two separate influx zones, wherein each of the at least two separate influx zones is provided with a delay path for a tracer leakout stream flow from that separate influx zone, the method comprising:

a) providing a global production flow change for the production flow in the well, b) establishing tracer concentrations in the production flow of the distinct tracer materials of each of the at least two separate influx zones as a function of time, and measuring time delays for tracer concentration changes of the distinct tracer materials from each of the at least two separate influx zones resulting from the global production flow change; and c) estimating the respective production flow rates from the at least two separate influx zones in the multilayer reservoir.

2. The method according to claim 1, wherein the distinct tracer sources are arranged in the at least two separate influx zones in the multilayer reservoir during completion of the well.

3. The method according to claim 1, wherein the distinct tracer sources are arranged in well equipment provided in the well.

4. The method according to claim 1, further comprising gradually decreasing the production flow rate until the tracer concentration of at least one of the distinct tracer materials in a sample of the production flow becomes zero.

5. The method according to claim 1, wherein the global production flow change comprises stepwise, gradually or continuously decreasing the production flow rate.

6. The method according to claim 1, wherein the global production flow change comprises stepwise, gradually or continuously increasing the production flow rate.

7. The method according to claim 1, wherein the global production flow change is provided by a ramp-up.

8. The method according to claim 1, further comprising, based on the tracer concentrations and their sampling times thereof during gradually decreasing production flow rates, establishing tracer concentration transients after each production flow rate change, and based on the tracer concentration transients after each production flow rate change, estimating production flow contributions from each of the at least two separate influx zones, noting a rate on which the distinct tracer materials in one of the at least two separate influx zones is disappearing and establishing rate-pressure curves for the at least two separate influx zones in the multilayer reservoir.

9. The method according to claim 1, wherein the global production flow change provides a flush-out of the distinct tracer materials.

10. The method according to claim 1, wherein the fluids are at least one of water, oil or gas.

11. Use of the method according to claim 1 for indicating potential crossflow in wells that are draining multilayer reservoirs.

12. Use of the method according to claim 1 for estimating influx volumes of fluids from zones in a multilayer reservoir with potential crossflow to a production flow in a well.

13. The method according to claim 1, wherein each of the at least two separate influx zones is provided with a specific entry point for the tracer leakout stream flow from that separate influx zone.

14. The method according to claim 13, wherein the distinct tracer sources are arranged in the at least two separate influx zones in the multilayer reservoir during completion of the well.

15. The method according to claim 1, further comprising establishing the production flow rate for which the tracer concentration of at least one of the distinct tracer materials is disappearing from the production flow.

16. The method according to claim 15, further comprising gradually decreasing the production flow rate until the at least one of the distinct tracer materials is disappearing from the production flow.

17. The method according to claim 1, wherein the global production flow change comprises flowing the well with (i) a first production flow at a first production flow rate and (ii) a second production flow at a second production flow rate, wherein the second production flow rate is lower than the first production flow rate, and the method further comprises:

i)

flowing the well at the first production flow rate, collecting consecutive samples of the first production flow at a topside as a function of time or collecting cumulative production volumes of the first production flow at the topside, and establishing concentrations of the distinct tracer materials from each of the at least two separate influx zones during the first production flow, and ii)

flowing the well at the second production flow rate, collecting consecutive samples of the second production flow at the topside as a function of time or collecting cumulative production volumes of the second production flow at the topside, and establishing concentrations of the distinct tracer materials from each of the at least two separate influx zones during the second production flow.

18. The method according to claim 17, further comprising:

repeating step ii) for a number of production flow rates decreasing from the second production flow rate, monitoring tracer concentration transients in the production flow after each production flow rate decrease, and estimating production flow contributions from each of the at least two separate influx zones.

19. The method according to claim 18, wherein decreasing the production flow rate from the second production flow rate comprises gradually decreasing the production flow rate.

20. The method according to claim 18, wherein decreasing the production flow rate from the second production flow rate comprises stepwise decreasing the production flow rate.

21. A system for estimating production flow rates of fluids from each of separate influx zones in a multilayer reservoir to a production flow in a well in the multilayer reservoir, wherein the well has at least two separate influx zones from the multilayer reservoir of known positions along the well, the system comprising:

distinct tracer sources with distinct tracer materials arranged in known positions in each of the at least two separate influx zones of the well, wherein a delay path is provided for a tracer leakout stream flow from the distinct tracer sources in each of the at least two separate influx zones in the multilayer reservoir; and an apparatus for establishing tracer concentrations in the production flow of the distinct tracer materials as a function of time during a global flow change for the production flow in the well, and estimating the respective production flow rates from the at least two separate influx zones in the multilayer reservoir.

22. Use of the system according to claim 21 for estimating influx volumes of fluids from zones in a reservoir with potential crossflow to a production flow in a well.

23. The system according to claim 21, wherein the distinct tracer sources are arranged in the at least two separate influx zones in the multilayer reservoir during completion of the well.

24. The system according to claim 21, wherein the distinct tracer sources are arranged in a reservoir formation, in a completion, in a casing, in a liner, or in equipment provided in the well.

25. The system according to claim 21, wherein the distinct tracer materials are released upon interaction with a well fluid.

26. The system according to claim 21, wherein the fluids are at least one of water, oil or gas.

27. Use of the system according to claim 21 for indicating potential crossflow in wells that are draining multilayer reservoirs.

28. The system according to claim 21, wherein the delay path in each of the at least two separate influx zones is provided by a distance between the distinct tracer sources and an entry point for the tracer leakout stream flow into a production baseline of the well.

29. The system according to claim 28, wherein the distinct tracer sources are arranged in the at least two separate influx zones in the multilayer reservoir during completion of the well.

* * * * *